US005125577A

United States Patent [19]

Frankel

[11] Patent Number: 5,125,577

[45] Date of Patent: Jun. 30, 1992

[54] COMBINATION LIQUID SOAP DISPENSER AND PROTECTIVE COVER FOR WATER FIXTURES

[75] Inventor: Gail B. Frankel, Dallas, Tex.

[73] Assignee: Kel-Gar, Inc., Dallas, Tex.

[21] Appl. No.: 603,891

[22] Filed: Oct. 26, 1990

Related U.S. Application Data

[63] Continuation-in-part of Ser. No. 405,006, Sep. 8, 1989.

[51] Int. Cl.[5] ..... B05B 7/30; B05B 15/00

[52] U.S. Cl. ..... 239/211; 239/288; 239/289; 239/310

[58] Field of Search ..... 239/211, 310, 10, 288, 239/288.3, 288.5, 289; D23/34, 35, 36

[56] References Cited

U.S. PATENT DOCUMENTS

| | | | |
|---|---|---|---|
| 1,517,926 | 12/1924 | Weckesser | 239/310 X |
| 1,893,972 | 1/1933 | Whitman | 239/211 X |
| 2,564,618 | 8/1951 | Williams | 239/310 X |
| 3,199,788 | 8/1965 | Davis | 239/310 |
| 3,612,404 | 10/1971 | Vicari | 239/379 X |
| 4,131,232 | 12/1978 | Pollinzi | 239/379 X |
| 4,463,462 | 8/1984 | Greenhut | 239/310 X |
| 4,821,960 | 4/1989 | Goldman | 239/211 |

*Primary Examiner*—Andres Kashnikow
*Assistant Examiner*—Kevin Weldon
*Attorney, Agent, or Firm*—Konneker & Bush

[57] ABSTRACT

A combination liquid soap dispenser and protective cover for a water ejecting fixture. A protective cover having an interior opening and first and second apertures in communication with the interior opening and a liquid soap dispenser having a narrow aperture in communication with the interior opening are attached together. Liquid soap is drawn out of the liquid soap dispenser and through the interior opening where the liquid soap mixes with water flowing therethrough.

25 Claims, 4 Drawing Sheets

COMBINATION LIQUID SOAP DISPENSER AND PROTECTIVE COVER FOR WATER FIXTURES

CROSS REFERENCE TO RELATED APPLICATIONS

This application is a Continuation-in-Part of U.S. Pat. application Ser. No. 07/405,006 filed Sept. 8, 1989, pending, which is hereby incorporated by reference as if reproduced in its entirety.

BACKGROUND OF THE INVENTION

1. Field of the Invention

This invention relates to a protective cover for a water fixture and more particularly to a protective cover which incorporates liquid soap dispensing means.

2. Description of Related Art

The use of decorative and protective covers for various types of water fixtures are known in the art. For example, U.S. Pat. No. 4,353,139 to Wainwright et al. discloses a protective cover formed of a soft, deformable cushioning material having a first opening for receiving the fixture spout and a second opening through which the end of the bathtub spout exits. The front of the cover has an animal shaped head attached thereon for decorative purposes. The animal shaped head is, however, an attachment to the protective cover and as such bears no relation to the ejection of water from the protective cover. Another cover for a water fixture may be seen by reference to U.S. Pat. No. 4,821,960 to Goldman. Here, a covering adapted for placement over a shower head is disclosed. The covering is provided with an aperture extending therethrough for receiving the shower head therein such that the shower head projects through an opening on the exterior surface of the covering. Preferably the cover is shaped in the form of an animal or human head and the shower head projects from a mouth shaped opening therein. Finally an ornamental cover for a bathtub spout which bears a strong resemblance to an elephant's head may seen in U.S. Pat. No. Des. 218,563 to Beene. Here, the ornamental cover includes a base member having an outer periphery shaped to resemble the outline of an elephant's head and a flat front surface upon which the facial features of an elephant are imprinted thereof and a downwardly extending trunk section extending from the front surface. The back surface of the base member includes an opening apparently for receiving the bathtub spout. Similarly the end of the downwardly extending trunk is provided with an opening apparently for the exit of water.

It is an object of this invention to provide a protective cover for a water fixture.

It is another object of this invention to a protective cover for a water fixture which includes liquid soap dispensing means attached thereto.

It is yet another object of this invention to provide a protective cover for a water fixture which includes liquid soap dispensing means attached thereto in which the liquid soap is drawn out by the flow of water through the protective cover and mixed therewith before entering the bath.

SUMMARY OF THE INVENTION

In one aspect, the present invention comprises a combination liquid soap dispenser and protective cover for a water ejecting fixture which comprises a protective cover having an interior opening and first and second apertures in communication with the interior opening. The first aperture and the interior opening are sized to receive the fixture therein, thereby supportably mounting the protective cover to the fixture. A liquid soap dispenser having an aperture in communication with the interior opening is attached to the protective cover Pressure produced by the flow of water through the interior opening draws liquid soap out of the dispenser. The water and liquid soap mix in the turbulent water flow and the mixture exits through the exit aperture.

In another aspect, the present invention comprises a combination liquid soap dispenser and protective cover for a water ejecting fixture which comprises a protective cover having an interior opening for supportably mounting the protective cover to the fixture and first and second apertures in communication with the interior opening A liquid soap dispenser having an aperture in communication with the interior opening is also provide In one aspect of this embodiment, the liquid soap dispenser is integrally formed with the protective cover In another aspect, the liquid soap dispenser is attached to the protective cover Liquid soap entering the interior opening through the liquid soap dispenser aperture and a mixture water and liquid soap is ejected through the exit aperture.

BRIEF DESCRIPTION OF THE DRAWING

The present invention may be better understood and its numerous objects, features and advantages will become apparent to those skilled in the art by reference to the accompanying drawing in which.

DETAILED DESCRIPTION OF THE INVENTION

Figure 1:
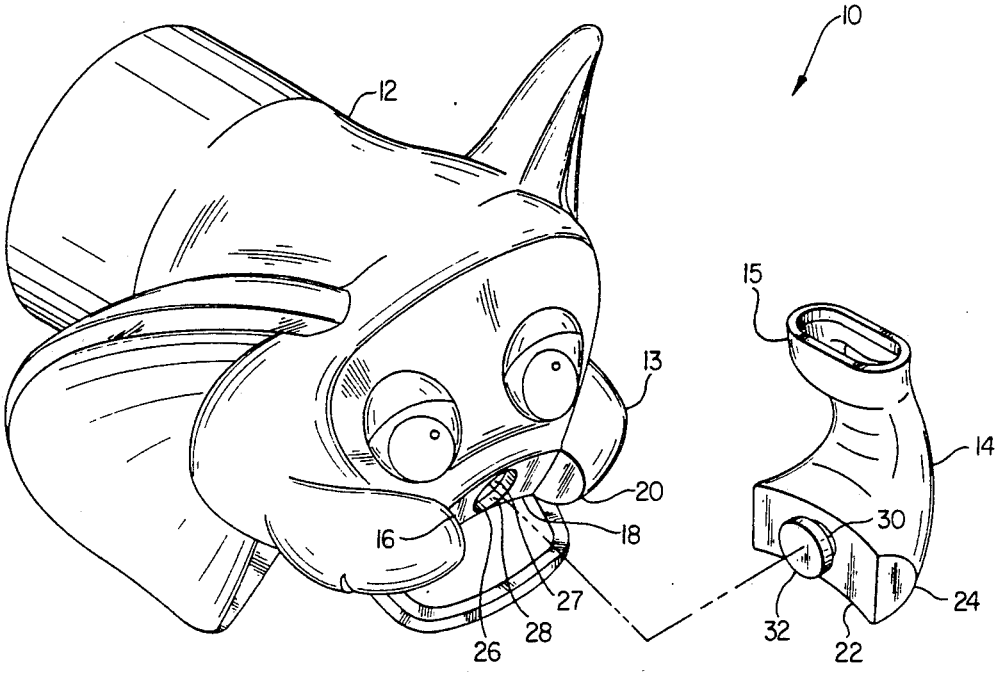
FIG. 1 is an exploded perspective view of a first embodiment of a combination liquid soap dispenser and protective cover constructed in accordance with the teachings of the present invention.

Referring now to the drawings wherein like reference numerals designate identical or similar elements throughout the several views, depicted in FIG. 1 is a combination liquid soap dispenser and protective cover 10 constructed in accordance with the teachings of the present invention may now be described in detail. The combination liquid soap dispenser and protective cover 10 is comprised of a protective cover 12, preferably constructed of a soft rubber material, and a liquid soap dispenser 14, also preferably constructed of a soft rubber material. Accordingly, in the event that the head or other portion of the body accidentally strikes a water ejecting fixture, most commonly constructed of a hardened metal such as steel, to which the combination liquid soap disperser and protective cover 10 is mounted the combination liquid soap dispenser and protective cover cushions the impact of the blow, thereby reducing the likelihood of serious injury. Finally. in the preferred embodiment of the invention the protective cover 12 should include an outer surface 13 shaped to resemble the trunk-less head of an elephant and the liquid soap dispenser 14 should include an outer surface 15 shaped to resemble the trunk of an elephant.

The trunk-less elephant head shaped outer surface 13 includes an indentation 16 provided therein in the location where an elephant's trunk would normally be found. The indentation 16 is defined by an inner face 18 and first and second side faces 20 integrally formed with the outer surface 13. The inner face 18 includes a projection receiving aperture 27 integrally formed therein The projection receiving aperture 27 is comprised of a first generally cylindrical section 26 integrally formed with the inner face 18 and a second generally cylindrical section 28 integrally formed with the first generally cylindrical section 26 and having a diameter greater than the diameter of the first generally cylindrical section 26.

Similarly, the trunk shaped outer surface 15 of the liquid soap dispenser 14 includes a first inner sidewall 22, and first and second sidewalls 24 having dimensions which correspond to the dimensions of the indentation 16. The inner sidewall 22 includes a first generally cylindrical projection 30 integrally formed therewith and having a diameter corresponding to the diameter of the first generally cylindrical section 26 and a second generally cylindrical projection 32 integrally formed with the first generally cylindrical projection 30 and having a diameter corresponding to the diameter of the second generally cylindrical aperture 28. To mount the liquid soap dispenser 14 to the protective cover 12, the second generally cylindrical projection 32 is inserted into the first projection receiving aperture 27 where the second generally cylindrical projection 32 will be held in place in the second wide generally cylindrical section 28 by the first, narrowed, generally cylindrical section 26. The first and second sidewalls 24 will then engage the side faces 20. If desired a layer of an adhesive material such as a glue may be provided between the inner face 18 and the first and second side faces 20 and the sidewalls 22, 24 to strengthen the engagement of the liquid soap dispenser 14 and the protective cover 12. In such a manner the trunk-less elephant head shaped outer surface 13 of the protective cover 12 combines with the elephant trunk shaped outer surface 15 of the liquid soap dispenser 14 to provided a combined outer surface which resembles the complete head of an elephant.

Figure 2:
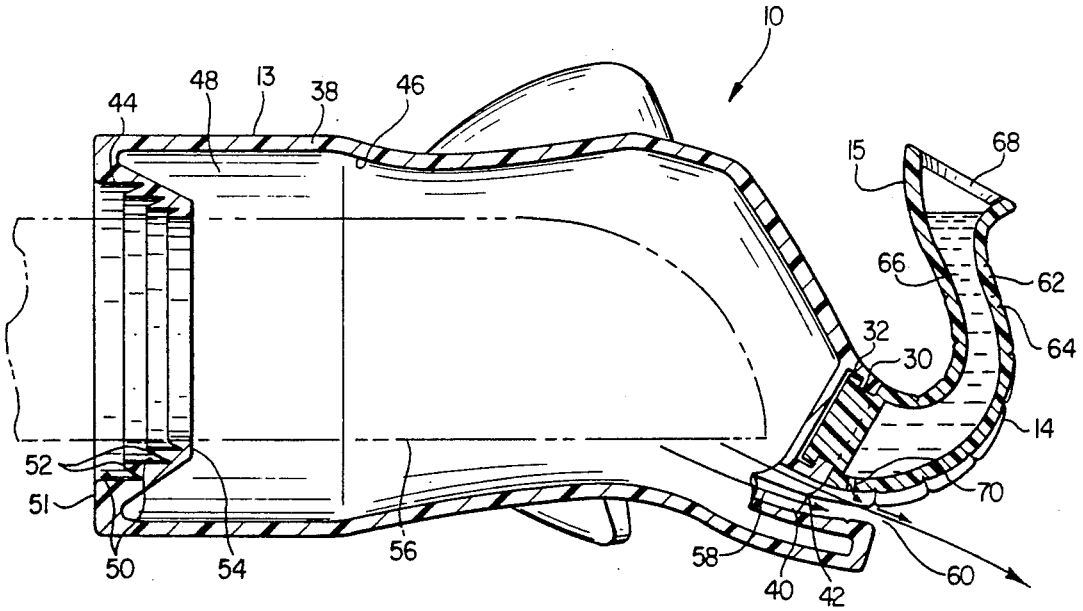
FIG. 2 is a cross-sectional view of the combination liquid soap dispenser and Protective cover of FIG. 1 taken along lines 2—2.

Referring next to FIG. 2, the combined liquid soap dispenser and protective cover 10 illustrated in FIG. 1 shall now be described in greater detail. The protective cover 12 is comprised of an outer sidewall 38 and first, second and third inner sidewalls 40, 42, 44 integrally formed together. One side of the outer sidewall 38 is the trunk-less elephant head shaped outer surface 13 previously described with respect to FIG. 1 and the other side of the outer sidewall is an inner surface 46 which defines a water fixture receiving interior opening 48. The third inner sidewall 44 is comprised of a plurality of concentric circular sections 50 integrally formed together to define an outwardly projecting lip 52 for each concentric circular section 50. As the third inner sidewall 44 extends inwardly from the outer sidewall 38, each consecutive concentric circular section 50 is provided with an increasingly smaller diameter the third inner sidewall 44 finally terminating in an inwardly projecting lip 54.

To mount the combination liquid soap dispenser and protective cover 10 to a water ejecting fixture 56 (illustrated in phantom in FIG. 2) such as a bathtub spout, the protective cover 12 is Placed over the fixture 56 such that the fixture 56 is inserted into the interior opening 48 until a back side 51 of the outer sidewall 38 engages a wall or other supportive member (not shown in FIG. 2) from which the fixture 56 projects. The fixture 56 engages the innermost concentric circular section 50 of the inner sidewall 44. Depending on the size and shape of the fixture 56, the fixture 56 may engage the inner surface 46 to provide additional support of the combination liquid soap dispenser and protective cover 10 although it is fully contemplated that the engagement of the inner sidewall 44 and the fixture 56 will satisfactorily support the mounting of the combination liquid soap dispenser and protective cover 10 on the fixture 56.

The first and second inner sidewalls 40 and 42, which in the preferred embodiment of the invention are shaped to resemble the mouth of an elephant, define a narrower section 58 of the interior opening 48 which terminates in an exit aperture 60. When water is ejected by the fixture 56, for example, by turning the handle of a bathtub faucet or spigot counterclockwise a distance sufficient to open the faucet flow opening, the ejected water exits the combination liquid soap dispenser and protective cover 10 enters the narrower section 58 where it increases in velocity due to the reduced area of the narrower section and exits the combination liquid soap dispenser and protective cover 10 through the exit aperture 60.

Continuing to refer to FIG. 2, the liquid soap dispenser 14 is comprised of an outer sidewall 62 integrally formed with the front inner wall 22 and the first and second and side inner walls 24. One side of the outer sidewall 62 is the elephant trunk shaped outer surface 15 previously described with respect to FIG. 1 and the other side of the outer sidewall 62 is an inner surface 64 which defines an interior opening 66 for holding a relatively high viscosity i.e. having a viscosity greater than the viscosity of water fluid More specifically, it is contemplated that, in accordance with one aspect of the invention the interior opening be used to hold liquid soap, bubble bath, conditioners, moisturizers, or other liquid additives used in connection with a bath. Furthermore, in the preferred embodiment of the invention the interior opening 66 should be sized to hold an amount of bubble bath approximately one ounce, typically used for administering a bubble bath to a toddler or other small child. The outer sidewall 62 further defines a receiving aperture 66 positioned near the top of the liquid soap dispenser 14 for filling the interior opening 64 with a selected high viscosity fluid such as any of the fluids set forth above. The outer sidewall 62 is further provided with a narrow passageway or fluid dispensing aperture 70 positioned near the bottom of the liquid soap dispenser 14. Preferably, the fluid dispensing aperture 70 should be positioned such that it will terminate in the narrower section 58 of the interior opening 48.

As the fluid dispensing aperture 70 is positioned near the bottom of the liquid soap dispenser 14, the force of gravity will tend to cause a high viscosity bubble bath to flow through the aperture 70. For example, in the absence of any flow of water through the narrower section 58 of the interior opening 48, i.e. when the water ejecting fixture is turned off, and utilizing the embodiment of the invention illustrated in FIG. 2, approximately two minutes were required to empty the liquid soap dispenser 14 after being filled with a relatively high viscosity bubble bath. Accordingly in one aspect of the invention, it is contemplated that the liquid soap dispenser is emptied due to the force of gravity. When, however water flows through the narrower section 58 of the interior opening 48, i.e. when the water ejecting fixture is turned more less than one minute was required to empty the liquid soap dispenser 14 of a similar amount of the relatively high viscosity bubble bath. This result occurs because, by positioning the fluid dispensing aperture 70 in the narrower section 58 of the interior opening 48, the water ejected by the fixture 56 and exiting through the exit aperture 60 draws fluid being held in the liquid soap dispenser 14 through the fluid dispensing aperture 70 where mixing between the water and the bubble bath may occur. As a result, the ejected water and the bubble bath are premixed before entering a tub or other water collecting device (not shown) positioned to receive the water ejected through the exit aperture 60 and foaming or other reactions produced by mixing the ejected water and the drawn fluid begin more readily. Furthermore, by positioning the fluid dispensing aperture before the end of the first inner surface 40, the first inner surface acts as a mixing surface which agitates the ejected water and drawn fluid to improve mixing of the two before the mixture enters the tub or other water collecting device. It is further contemplated that the extent to which the ejected water and the drawn fluid are mixed could be increased by lengthening the first inner surface 40.

Figure 3:
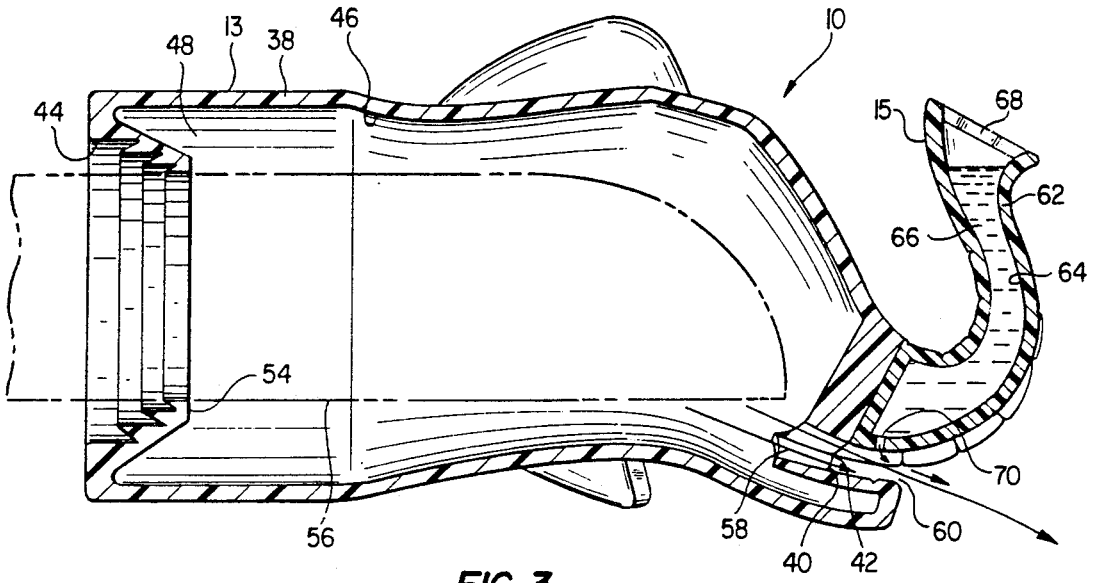
FIG. 3 is a cross-sectional view of a second embodiment of a combination liquid soap dispenser and protective cover-constructed in accordance with the teachings of the present invention.

In yet another aspect of the invention the fluid dispensing aperture 70 may be positioned at the narrowest point along the narrower section 58 such that the velocity of the flowing water is at its greatest and the rate at which the bubble bath is drawn from the liquid soap dispenser is at its greatest as well. Referring next to FIG. 3, a second embodiment of a combination liquid soap dispenser and protective cover constructed in accordance with the teachings of the present invention. In this embodiment, the inner face 18 and first and second side faces 20 of the indentation 16 in the protective cover 12 are formed as substantially flat surfaces. Similarly, the inner face 22 and first and second side faces of the liquid soap dispenser 14 are formed as substantially flat surfaces as well. To mount the liquid soap dispenser 14 to the protective cover 12, the inner face 22 and the first and second side faces 24 are covered with an adhesive material and pressed against the inner face 18 and the first and second side faces 20 until the adhesive material sets. Once attached together, the trunk-less elephant head shaped outer surface 13 of the protective cover 12 sometimes with the elephant trunk shaped outer surface 15 of the liquid soap dispenser 14 to provided a combined outer surface which resembles the complete head of an elephant.

Figure 4:
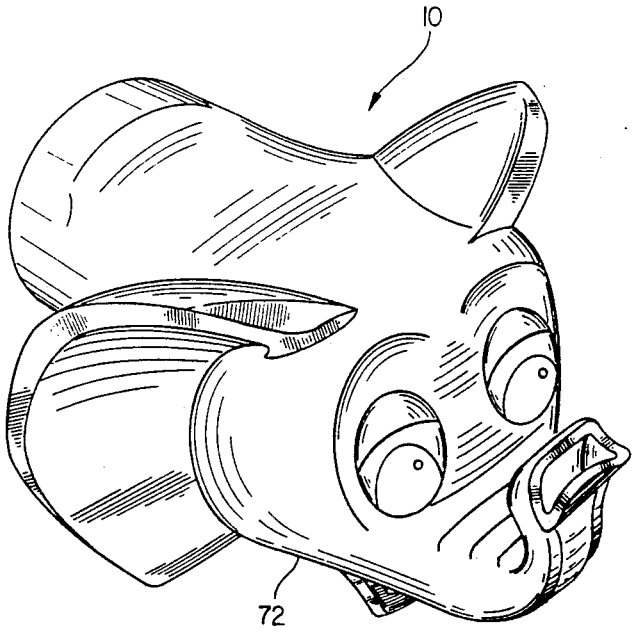
FIG. 4 is a perspective view of a third embodiment of a combination liquid soap dispenser and protective cover constructed in accordance with the teachings of the present invention.

Referring next to FIG. 4, a third embodiment of a combination liquid soap dispenser and protective cover constructed in accordance with the teachings of the present invention may now be seen In this embodiment of the invention, the combination liquid soap dispenser and protective cover 10 is formed as a single molded piece of a soft rubber material. Preferably, the combination liquid soap dispenser and protective cover 10 should include an outer surface 72 shaped to resemble the head of an elephant.

Figure 5:
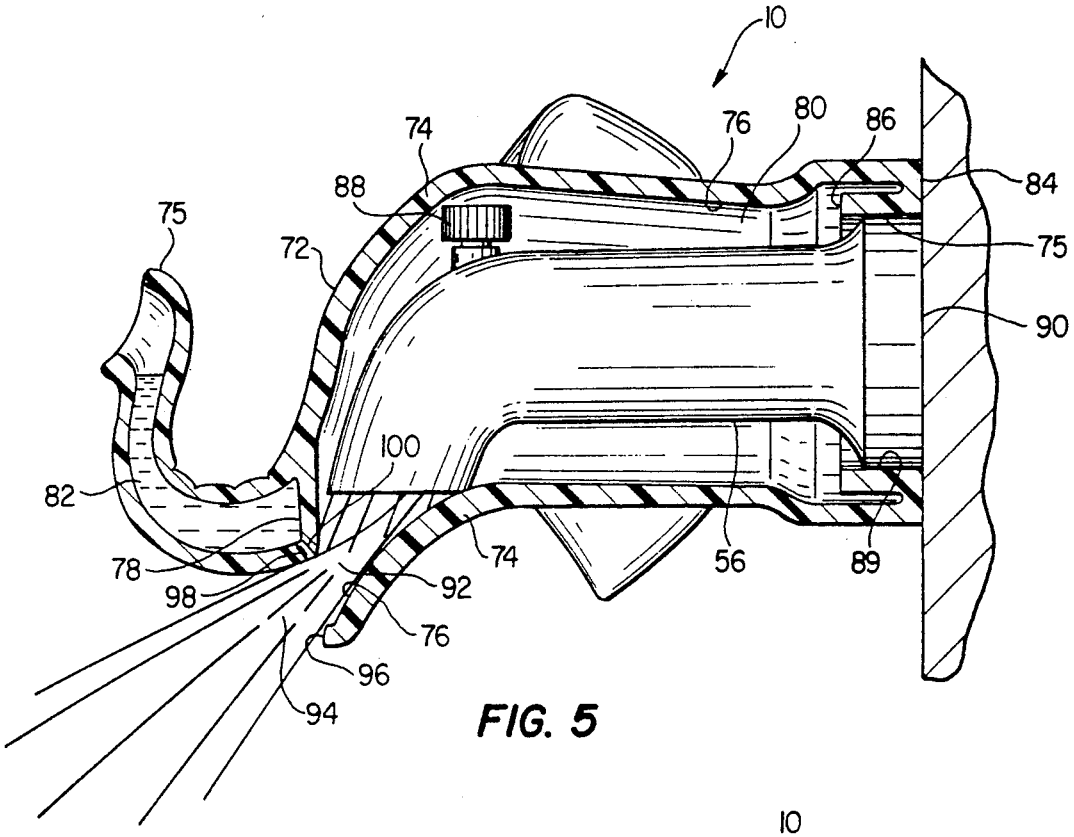
FIG. 5 is a cross-sectional view of the combination liquid soap dispenser and protective cover of FIG. 4 taken along lines 5—5.

Referring next to FIG. 5, the one-piece combination liquid soap dispenser and protective cover 10 illustrated in FIG. 4 shall now described in greater detail. The one-piece combination liquid soap dispenser and protective cover 10 is comprised of an outer sidewall 74, a first inner sidewall 75 and a second inner sidewall 78, integrally formed together. One side of the outer sidewall 74 is the elephant head shaped outer surface 72 previously described with respect to FIG. 4 and the other side of the outer sidewall 74 is an inner surface 76 which defines an interior space which is divided by the inner sidewall 78 into a first, fixture receiving interior chamber 80 and a second interior chamber 82. A back wall 84 integrally connects the outer sidewall 74 and the second inner sidewall 75. More specifically in the embodiment described herein the second inner sidewall 75 is a cylindrically shaped sidewall having a diameter less than the diameter of the outer sidewall 74 and positioned generally concentric therewith. The second inner sidewall 75 extends inwardly from the back wall 84 and terminates in an inwardly projecting cylindrical lip 86.

To mount the combination liquid soap dispenser and protective cover 10 to a water ejecting fixture 56, for example, a bathtub spout, having a spigot 88, the combination liquid soap dispenser and protective cover 10 is placed over the fixture 56 such that the fixture 56 is inserted through an aperture 89 which is defined by the second inner sidewall 75 into the first interior chamber 80, preferably until the back wall 84 engages a wall 90 or other supportive member from which the fixture 56 projects. In this position the fixture 56 would be supportably engaged by the inner sidewall 75. Depending on the size and shape of the fixture 56, the fixture 56 may engage the inner surface 76 at other locations to provide additional support of the combination liquid soap dispenser and protective cover 10 although it is fully contemplated that the engagement of the inner sidewall 75 and the fixture 56 will satisfactorily support the mounting of the combination liquid soap dispenser and protective cover 10 on the fixture 56.

While the combination liquid soap disperser and protective cover 10 could be very readily slid off the fixture 56 illustrated in FIG. 2 to disengage the two, the fixture 56 illustrated in FIG. 5 includes a projecting spigot 88 similar to those often found on water ejecting fixtures 56 used in bathtubs. The spigot 88 projects upwardly a sufficient distance such that it would very likely catch on the inwardly projecting cylindrical lip 86 when removal of the combination liquid soap dispenser and protective cover 10 is attempt. By constructing the combination liquid soap dispenser and protective cover 10 from a rubber material which softens when heated, the combination liquid soap dispenser and protective cover 10 may be more easily removed then heated is ejected from the fixture 56 for a short period of time, for example, several minutes, to soften the rubber such that the combination liquid soap dispenser and protective cover becomes more readily deformable and will more easily detach from the fixture 56 without tearing As previously set forth the combination liquid soap dispenser and protective cover 10 includes the first chamber 80 which receives the water ejecting fixture and the second chamber 82 for receiving a liquid soap therein An narrow section 92 of the first interior chamber 80 through which water ejected by the fixture 56 is dispensed is defined by the inner sidewall 78 and the inner side 76 of the outer sidewall 74. Preferably, the narrower section 92 terminates in an exit aperture 94 defined by an end portion 96 of the outer sidewall 74. When water is ejected by the fixture 56, for example, by turning the handle of a bathtub faucet counterclockwise a distance sufficient to open the faucet flow opening the ejected water exiting the combination liquid soap disperser and protective cover 10 enters the narrower section 92 where it increases in velocity due to the reduced area of the narrower section and exits the combination liquid soap dispenser and protective over 10 through the exit aperture 94.

Continuing to refer to FIG. 5, the inner sidewall 78 has a narrow aperture 98 formed therein through which a liquid held in the second inner chamber 82 may exit. Preferably, the narrow aperture 98 is formed at a lower end 100 of the inner sidewall, i.e. where the outer sidewall 74 and inner sidewall 78 are integrally formed together at the base of the trunk shaped section of the elephant head. By doing so it is ensured that the liquid exits at the narrowest point of the narrower section 78. As before, liquid soap or other high viscosity liquids are drawn out of the second inner chamber 82.

As the fluid dispensing aperture 70 is positioned near the bottom of the liquid soap dispenser section 75, the force of gravity will tend to cause a high viscosity bubble bath to flow through the aperture 98 in the absence of water flow at a first, relatively slow rate. Furthermore, in the presence of a flow of water being ejected by the fixture 56, the high viscosity liquid held in the liquid soap dispenser section 75 will be drawn into the water flow at a second relatively faster rate. where mixing between the two can occur before the water and liquid soap fall into the tub or other water collecting device (not shown) positioned to receive the ejected water.

Figure 6:
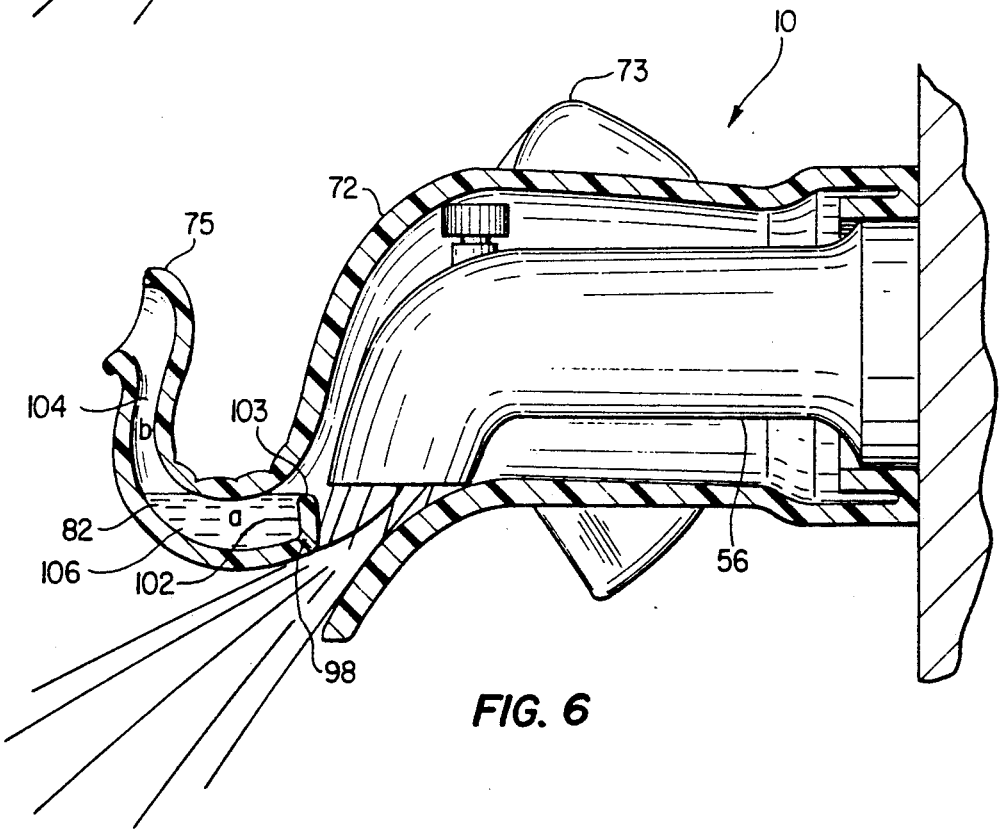
FIG. 6 is a cross-sectional view of a fourth embodiment of a combination liquid soap dispenser and protective cover constructed in accordance with the teachings of the present invention.

Referring next to FIG. 6, a fourth embodiment of a combination liquid soap disperser and protective cover constructed in accordance with the teachings of the present invention may now be seen In this embodiment of the invention, the combination liquid soap dispenser and protective cover 10 is again formed as a single molded piece which includes a first section 73 shaped to resemble a trunk-less head of an elephant integrally formed with a second section 75 shaped to resemble an elephant's trunk. Preferably the combination liquid soap dispenser and protective cover 10 should an outer surface 72 shaped to resemble the head of an elephant. In this embodiment, the inner sidewall 102 is left open at one end for ease of manufacture. The combination liquid soap dispenser and protective cover 10 operates as before except that the amount of liquid which may be held by now open second interior chamber 82 without spillage of the liquid over the inner sidewall 102 is now controlled by the height of the inner sidewall 102 and the volume of the passageway 104 formed in the raised portion of the elephant's trunk. Preferably the second interior chamber 82 should be shaped such that a volume "a" of a lower section 106 of the second interior chamber 82 is approximately equal to a volume "b". of the passageway 104 formed in the raised portion of the elephant s trunk. When so designed spillage of the liquid over the top 103 of the inner sidewall 102 will not occur when the second interior chamber 82 is filled with a liquid.

Figure 7:
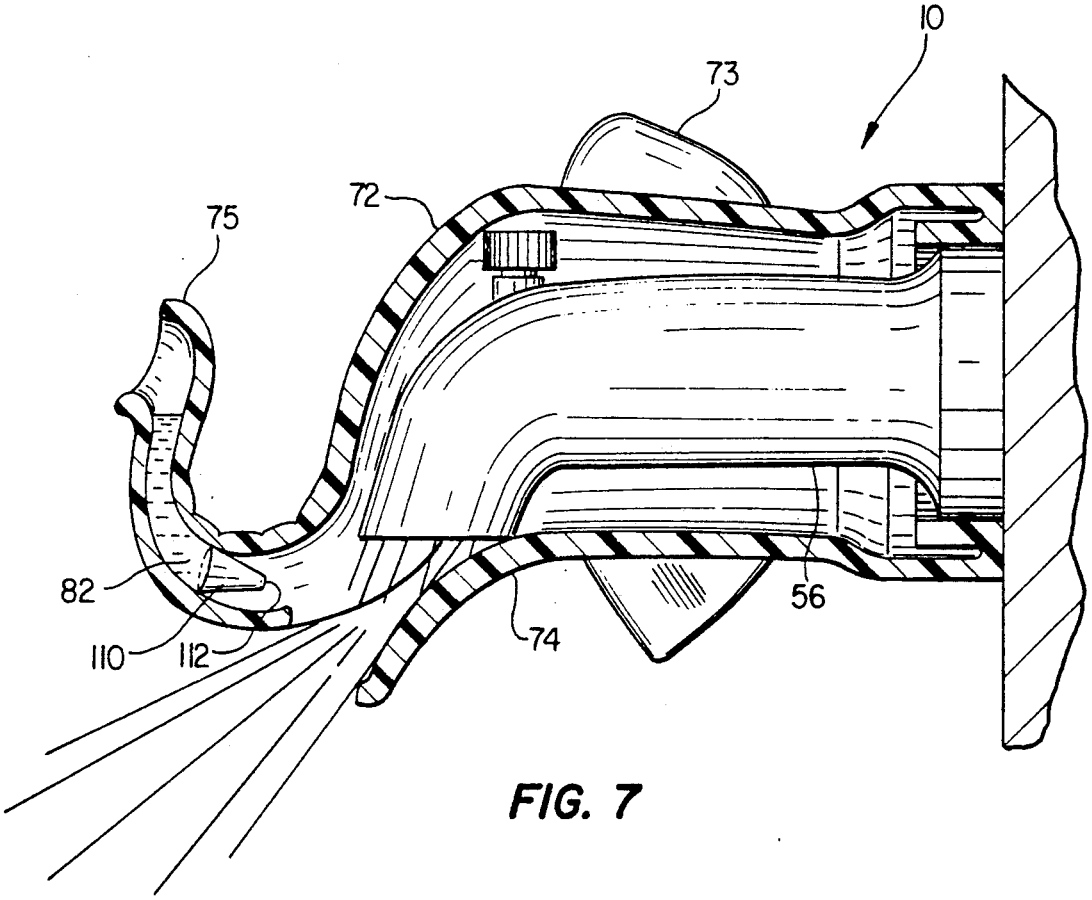
FIG. 7 is a cross-sectional view of a fifth embodiment of a combination liquid soap dispenser and protective cover constructed in accordance with the teachings of the present invention.

Referring next to FIG. 7, a fifth embodiment of a combination liquid soap dispenser and protective cover constructed in accordance with the teachings of the present invention may now be seen In this embodiment of the invention the combination liquid soap dispenser and protective cover 10 is again formed as a single molded piece. Regulation of the flow of liquid soap into the flow of water is controlled by a conical insert held in the interior of the second inner chamber 82 by the engagement of the walls of the second inner chamber 82 and the conical insert. Due to the force of gravity liquid soap deposited in the inner chamber 82 passes through the conical insert 10. A small aperture 112 provided at the tip of the conical insert 110 regulates the gradual flow of liquid soap out of the second chamber 82. It is contemplated that the conical insert 110 may be positioned anywhere in the trunk without significant affect in the operation of the invention. In alternate aspects of this embodiment of the invention, the second interior ohamh 82 may be open as illustrated in FIG. 7, such that the conical insert 110 completely regulates the flow of liquid soap and such that entry of the liquid soap into the water flow is greatly facilitated and is entirely controlled by a gravity feed. Alternately either a open second interior chamber 82 with a narrow aperture such as that previously described with respect to FIG. 6 may be provide. Finally, it is further contemplated that a closed interior chamber with a narrow exit aperture such as those described with respect to FIGS 1–4 may be utilized in this embodiment of the invention In these aspects of the invention the liquid soap would be supplied by a combination of a gravity feed followed by a draw feed.

Thus, there has been described and illustrated herein, a combination liquid soap dispenser and protective cover for a water ejecting fixture such as a bathtub spout in which liquid soap held in the soap dispenser section is drawn by the flow of water exiting the fixture receiving section for the automatic mixing of the two before entering a bathtub or other water collection device positioned therebelow. However, those skilled in the art will recognize that many modifications and variations besides those specifically mentioned may be made in the techniques described herein without departing substantially from the concept of the present invention Accordingly, it should be clearly understood that the form of the invention described herein is exemplary only and is not intended as a limitation on the scope of the invention.

What is claimed is:

1. A combination liquid soap dispenser and protective cover for a water ejecting fixture, comprising:

a protective cover having an interior opening and first and second apertures in communication with said interior opening, said first aperture and said interior opening being sized to receive said fixture, said interior opening including a wider section for receiving said fixture and a narrower section through which said water is ejected, said water ejected by said fixture flowing through said interior opening and exiting through said second aperture; and a liquid soap dispenser attached to said protective cover, said liquid soap dispenser having a soap dispensing aperture in communication with said narrower section;

said protective cover further comprising an outer sidewall and first and second inner sidewalls, said outer sidewall defining said wider section of said interior opening and said first and second inner sidewalls defining a first portion of said narrower section of said interior opening and wherein said protective cover further comprises an elongated outer member, said elongated outer member and said liquid soap dispenser forming a second portion of said narrower section of said interior opening;

wherein the flow of water through said interior opening draws liquid soap through said dispenser aperture for mixing with water flowing therethrough.

2. A combination liquid soap dispenser and protective cover as set forth in claim 1 and wherein dispenser aperture is in communication with said second portion of said narrower section of said interior opening.

3. A combination liquid soap dispenser and protective cover as set forth in claim 2 and wherein a first side of said elongated outer member provides a mixing surface for the flowing water and the drawn liquid soap.

4. A combination liquid soap dispenser and protective cover as set forth in claim 3 and wherein said outer sidewall has an indentation formed therein said indentation sized to receive said liquid soap dispenser.

5. A combination liquid soap dispenser and protective cover as set forth in claim 4 and wherein said liquid soap dispenser further comprises an outer sidewall, an interior opening defined by said outer sidewall and a soap receiving aperture in communication with said interior opening.

6. A combination liquid soap disperser and protective cover as set forth in claim 5 and wherein said indentation is positioned above said elongated outer member said liquid soap dispenser extending outwardly and upwardly from said indentation said soap receiving aperture being positioned higher than said soap dispensing aperture.

7. A combination liquid soap dispenser and protective cover as set forth in claim 6 and wherein said liquid soap dispenser further comprises at least one projection and said protective cover indentation is further provided with a corresponding number of projection receiving apertures.

8. A combination liquid soap dispenser and protective cover as set forth in claim 7 and wherein said liquid soap dispenser further comprises:

a first generally cylindrical projection extending from a side thereof; and a second side generally cylindrical projection integrally formed with said first projection;

wherein said protective cover indentation further comprises an inner face having a projection receiving aperture formed therein said projeotion receiving aperture having a first generally cylindrical section for receiving said second cylindrical projeotion therein and a second generally cylindrical section for receiving said first cylindrical projection therein thereby locking said second cylindrical projeotion in said first cylindrical section.

9. A combination liquid soap dispenser and protective cover as set forth in claim 6 and wherein said protective cover further comprises a third inner sidewall which defines said first, fixture receiving aperture of said protective cover.

10. A combination liquid soap dispenser and protective cover as set forth in claim 9 and wherein said third inner sidewall further comprises a plurality of concentric circular sections of increasingly smaller diameters, said third inner sidewall terminating in a circular inner lip.

11. A combination liquid soap dispenser and protective cover per as set forth in claim 10 and wherein each of said plurality of concentric circular sections further comprises a circular outer lip.

12. A combination liquid soap dispenser and protective cover as set forth in claim 6 and wherein said combination liquid soap dispenser and protective cover is shaped to resemble the head of an elephant.

13. A combination liquid soap dispenser and protective cover as set forth in claim 12 and wherein said outer sidewall is shaped to resemble the trunk-less head of an elephant and said liquid soap dispenser is shaped to resemble the trunk of an elephant.

14. A combination liquid soap dispenser and protective cover as set forth in claim 13 and wherein said first and second inner sidewalls are shaped to resemble the open mouth of an elephant.

15. A combination liquid soap dispenser and protective cover as set forth in claim 13 wherein said liquid soap dispenser and said protective cover are integrally formed together.

16. A combination liquid soap dispenser and protective cover for a water ejecting fixture, comprising:

a protective cover having an interior opening for supportably mounting said fixture and first and second apertures in communication with said interior opening, said water ejected by said fixture flowing through said interior opening and exiting through said second aperture; and a liquid soap dispenser having a soap dispensing aperture in communication with a narrower section of said interior opening;

said protective cover further comprising an elongated outer member, said elongated outer member and said liquid soap dispenser forming said narrower section of said interior opening;

wherein a mixture of said ejected water and said liquid soap is ejected through said second aperture.

17. A combination liquid soap dispenser and protective cover as set forth in claim 18 wherein said liquid soap dispenser is attached to said protective cover.

18. A combination liquid soap dispenser and protective cover as set forth in claim 17 wherein said soap dispensing aperture is positioned such that said liquid soap is drawn out of said liquid soap dispenser due to the force of gravity.

19. A combination liquid soap dispenser and protective cover as set forth in claim 17 wherein said soap dispensing aperture is positioned such that said liquid soap is drawn out of said liquid soap dispenser due to pressure produced by the flow of water through said interior opening.

20. A combination liquid soap dispenser and protective cover as set forth in claim 19 and wherein said protective cover is shaped to resemble the trunk-less head of an elephant and said liquid soap disperser is shaped to resemble the trunk of an elephant.

21. A combination liquid soap disperser and protective cover as set forth in claim 20 wherein said soap dispensing aperture is positioned such that said liquid soap is drawn out of said liquid soap dispenser due to the force of gravity.

22. A combination liquid soap dispenser and protective cover as set forth in claim 20 wherein said soap dispensing aperture is positioned such that said liquid soap is drawn out of said liquid soap dispenser due to pressure produced by the flow of water through said interior opening.

23. A combination liquid soap dispenser and protective cover as set forth in claim 22 and wherein said combination liquid soap dispenser and protective cover is shaped to resemble the head of an elephant.

24. A combination liquid soap disperser and protective cover as set forth in claim 21 and further comprising an insert supportably mounted in liquid soap dispenser said insert having a narrow aperture formed therein for regulating the flow of said liquid soap.

25. A combination liquid soap dispenser and protective cover as set forth in claim 24 and wherein said insert further comprises a tip section integrally formed with a conically shaped sidewall, said narrow aperture formed in said tip section and said conically shaped sidewalls engaging said liquid soap dispenser to supportably mount said insert therein.

* * * * *

UNITED STATES PATENT AND TRADEMARK OFFICE

CERTIFICATE OF CORRECTION

PATENT NO. : 5,125,577

DATED : June 30, 1992

INVENTOR(S) : Frankel, Gail B.

It is certified that error appears in the above-identified patent and that said Letters Patent is hereby corrected as shown below:

Column 1, line 38, "Finally" should be --Finally,--.

Column 1, line 45, "thereof" should be --thereon,--.

Column 1, line 48, "opening" should be --opening,--.

Column 1, line 50, "provided" should be --provided,--.

Column 1, line 50, "opening" should be --opening,--.

Column 1, line 54, "to a" should be --to provide a--.

Column 2, line 6, "cover" should be --cover.--.

Column 2, line 17, "opening A" should be --opening. A--.

Column 2, line 18-19, "provide" should be --provided.--.

Column 2, line 20, "cover" should be --cover.--.

Column 2, line 22, "cover" should be --cover.--.

Column 2, line 38, "Protective" should be --protective--.

Column 2, line 42, "cover-constructed" should be --cover constructed--.

Column 3, line 8, "disperser" should be --dispenser--.

Column 3, line 9, "mounted" should be --mounted,--.

Column 3, line 12, "invention" should be --invention,--.

Column 3, line 23, "therein" should be --therein.--.

UNITED STATES PATENT AND TRADEMARK OFFICE

CERTIFICATE OF CORRECTION

PATENT NO. : 5,125,577
DATED : June 30, 1992
INVENTOR(S) : Frankel, Gail B.

It is certified that error appears in the above-identified patent and that said Letters Patent is hereby corrected as shown below:

Column 3, line 47, "second wide" should be --second, wider,--.

Column 3, line 48, "narrowed" should be --narrower--.

Column 3, line 50, "desired" should be --desired,--.

Column 4, line 8, "diameter" should be --diameter,--.

Column 4, line 14, "Placed" should be --placed--.

Column 4, line 29, "which" should be --which,--.

Column 4, line 30, "invention" should be --invention,--.

Column 4, line 52, "water fluid" should be --water, fluid.--.

Column 4, line 54, "invention" should be --invention,--.

Column 4, line 57, "invention" should be --invention,--.

Column 4, line 59, "bath" should be --bath,--.

Column 5, line 16, "however" should be --however,--.

Column 5, line 18, "turned more less" should be --turned on less--.

Column 5, line 40, "could" should be --would--.

Column 5, line 63, "12 sometimes with" should be --12 combines with--.

Column 6, line 2, "seen" should be --seen.--.

Column 6, line 11, "now described" should be --now be described--.

UNITED STATES PATENT AND TRADEMARK OFFICE

CERTIFICATE OF CORRECTION

PATENT NO. : 5,125,577

DATED : June 30, 1992

INVENTOR(S) : Frankel, Gail B.

It is certified that error appears in the above-identified patent and that said Letters Patent is hereby corrected as shown below:

Column 6, line 20, "receiving" should be --receiving,--.

Column 6, line 23, "specifically" should be --specifically,--.

Column 6, line 24, "herein" should be --herein,--.

Column 6, line 50, "disperser" should be --dispenser--.

Column 6, line 51, "could" should be --would--.

Column 6, line 63, "removed then heated is" should be --removed when heated water is--.

Column 6, line 68, "tearing" should be --tearing.--.

Column 7, line 1, "forth" should be --forth,--.

Column 7, line 5, "therein An narrow section" should be --therein. An narrower section--.

Column 7, line 13, "opening" should be --opening,--.

Column 7, line 14-15, "disperser" should be --dispenser--.

Column 7, line 18, "over" should be --cover--.

Column 7, line 27, "so" should be --so,--.

Column 7, line 35, "slow" should be --slow,--.

Column 7, line 39, "second" should be --second,--.

Column 7, line 45, "disperser" should be --dispenser--.

UNITED STATES PATENT AND TRADEMARK OFFICE

CERTIFICATE OF CORRECTION

PATENT NO. : 5,125,577

DATED : June 30, 1992

INVENTOR(S) : Frankel, Gail B.

It is certified that error appears in the above-identified patent and that said Letters Patent is hereby corrected as shown below:

Column 7, line 47, "seen" should be --seen.--.

Column 7, line 53, "Preferably" should be --Preferably,--.

Column 7, line 54, "should an" should be --should include an--.

Column 7, line 64, "Preferably" should be --Preferably,--.

Column 7, line 67, " "b".of" should be --"b" of--.

Column 8, line 1, "elephant s" should be --elephant's--.

Column 8, line 1, "designed" should be --designed,--.

Column 8, line 8, "seen" should be --seen.--.

Column 8, line 9, "invention" should be --invention,--.

Column 8, line 15, "gravity" should be --gravity,--.

Column 8, line 17, "10." should be --110.--.

Column 8, line 24, "ohamh 82 may be open as" should be --chamber 82 may be open, as--.

Column 8, line 28, "Alternately" should be --Alternately,--.

Column 8, line 31, "provide." should be --provided.--.

Column 8, line 35, "invention In these aspects of the invention" should be --invention. In these aspects of the invention,--.

Column 8, line 49-50, "invention Accordingly," should be --invention. Accordingly,--.

UNITED STATES PATENT AND TRADEMARK OFFICE

CERTIFICATE OF CORRECTION

PATENT NO. : 5,125,577

DATED : June 30, 1992

INVENTOR(S) : Frankel, Gail B.

It is certified that error appears in the above-identified patent and that said Letters Patent is hereby corrected as shown below:

Column 9, line 26, "therein" should be --therein,--.

Column 9, line 34, "disperser" should be --dispenser--.

Column 9, line 36, "member" should be --member,--.

Column 9, line 38, "indentation" should be --indentation,--.

Column 9, line 52, "second side" should be --second, wider,--.

Column 9, line 56, "therein said projection" should be --therein, said projection--.

Column 9, line 59, "projeotion" should be --projection--.

Column 9, line 61, "therein" should be --therein,--.

Column 9, line 62, "projeotion" should be --projection--.

Column 9, line 67, "receiving" should be --receiving,--.

Column 10, line 8, "cover per as" should be --cover as--.

Column 10, line 62, "disperser" should be --dispenser--.

Column 12, line 1-2, "disperser" should be --dispenser,--.

Column 5, line 64-65, "provided" should be --provide--.

UNITED STATES PATENT AND TRADEMARK OFFICE

CERTIFICATE OF CORRECTION

PATENT NO. : 5,125,577

DATED : June 30, 1992

INVENTOR(S) : Frankel, Gail B.

It is certified that error appears in the above-indentified patent and that said Letters Patent is hereby corrected as shown below:

Column 7, line 39, "rate. where" should be --rate where--.

Signed and Sealed this

First Day of February, 1994

Bruce Lehman

*Attest:*

BRUCE LEHMAN

*Attesting Officer*

*Commissioner of Patents and Trademarks*